US012752897B2

(12) United States Patent
Fergus et al.

(10) Patent No.: US 12,752,897 B2
(45) Date of Patent: Oct. 6, 2026

(54) MARINE DRIVE STEERING ASSEMBLY SYSTEMS AND METHODS

(71) Applicant: Brunswick Corporation, Mettawa, IL (US)

(72) Inventors: Ryan A. Fergus, Neenah, WI (US); Andrew M. Sheely, Fond Du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 19/193,360

(22) Filed: Apr. 29, 2025

(65) Prior Publication Data

US 2025/0340281 A1 Nov. 6, 2025

Related U.S. Application Data

(60) Provisional application No. 63/640,983, filed on May 1, 2024.

(51) Int. Cl.
*B63H 20/12* (2006.01)

(52) U.S. Cl.
CPC ..... *B63H 20/12* (2013.01)

(58) Field of Classification Search
CPC ..... B63H 20/12
See application file for complete search history.

(56) References Cited

U.S. PATENT DOCUMENTS

| | | | | |
|---|---|---|---|---|
| 7,941,253 | B1 * | 5/2011 | Brant | B63H 21/213 701/21 |
| 8,113,892 | B1 * | 2/2012 | Gable | B63H 21/21 114/144 RE |
| 8,818,587 | B1 | 8/2014 | Arbuckle | |
| 9,598,163 | B1 * | 3/2017 | Gable | B63H 20/12 |
| 9,771,137 | B1 * | 9/2017 | Gable | B63H 20/12 |
| 9,908,606 | B1 * | 3/2018 | Andrasko | B63H 21/213 |
| 10,518,858 | B1 | 12/2019 | Klawitter | |
| 11,235,847 | B1 | 2/2022 | Malouf | |
| 12,030,607 | B1 * | 7/2024 | Kirchhoff | B63H 25/42 |
| 2022/0144401 | A1 * | 5/2022 | Malouf | B63H 20/12 |
| 2022/0306260 | A1 * | 9/2022 | Kamnick | B63H 20/12 |

* cited by examiner

*Primary Examiner* — Richard M Camby
(74) *Attorney, Agent, or Firm* — Andrus Intellectual Property Law, LLP

(57) ABSTRACT

A method of controlling steering for a marine vessel includes sensing at least one position of at least one drive assembly on the marine vessel, wherein each drive assembly includes a marine drive, a mounting assembly configured to pivotably support the marine drive, and a steering assembly configured to pivot the marine drive about its respective steering axis. The method further includes determining a minimum clearance between the drive assembly and an obstruction based on the at least one sensed position and setting at least one operational parameter for the steering assembly based on the minimum clearance, wherein setting the at least one operational parameter includes setting a maximum pivot speed for pivoting the marine drive about its steering axis and a maximum actuation force for pivoting the marine drive about its steering axis. The steering assembly is then controlled based on the at least one operational parameter.

21 Claims, 8 Drawing Sheets

MARINE DRIVE STEERING ASSEMBLY SYSTEMS AND METHODS

CROSS-REFERENCE TO RELATED APPLICATIONS

This application claims benefit of, and claims priority to U.S. Provisional Application 63/640,983, filed May 1, 2024, which is hereby incorporated herein by reference in its entirety for all purposes.

FIELD

The present disclosure relates to steering systems for steering marine drives, and in particular, systems and methods for controlling steering systems to steer marine drives.

BACKGROUND

U.S. Pat. No. 8,818,587 is incorporated herein by reference and discloses methods and systems for controlling movement of at least one propulsion unit on a marine vessel. The method comprises plotting a first plurality of points representing a first surface of a first propulsion unit and plotting a second plurality of points representing a second surface. The method further comprises limiting movement of at least the first propulsion unit such that the first surface does not come within a predetermined distance of the second surface during said movement.

U.S. Pat. No. 10,518,858 is incorporated herein by reference and discloses a steering actuator for steering an outboard marine engine about a steering axis. The steering actuator has a piston device and a valve device. Hydraulic actuation of the piston device causes the outboard marine engine to pivot about the steering axis. The valve device controls a flow of hydraulic fluid to the piston device to thereby hydraulically actuate the piston device. The valve device comprises a lead screw, a motor configured to rotate the lead screw in a first rotational direction and alternately in an opposite, second rotational direction, and a ball nut coupled to the lead screw such that rotation of the lead screw causes the ball nut to axially move along the lead screw, and wherein axial movement of the ball nut along the lead screw actuates the valve device, which thereby actuates the piston device to steer the outboard marine engine.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In non-limiting examples disclosed herein, a method is for controlling a propulsion assembly for a marine vessel comprising at least one marine drive and a steering assembly for steering the at least one marine drive relative to the marine vessel. The method includes sensing a position of the at least one marine drive, determining a minimum clearance between the propulsion assembly and an obstruction, and setting operational parameters for the steering assembly based on the minimum clearance.

In non-limiting examples disclosed herein, a method of controlling steering for a marine vessel includes sensing at least one position of at least one drive assembly on the marine vessel, wherein each drive assembly includes a marine drive, a mounting assembly configured to pivotably support the marine drive on the marine vessel, and a steering assembly configured to pivot the marine drive about its respective steering axis. The method further includes determining a minimum clearance between the drive assembly and an obstruction based on the at least one sensed position and setting at least one operational parameter for the steering assembly based on the minimum clearance, wherein setting the at least one operational parameter includes setting a maximum pivot speed for pivoting the marine drive about its steering axis and a maximum actuation force for pivoting the marine drive about its steering axis. The steering assembly is then controlled based on the at least one operational parameter.

A steering control system for a marine vessel includes at least one sensor configured to sense a position of at least one drive assembly on the marine vessel, wherein each drive assembly includes a marine drive, a mounting assembly configured to pivotably support the marine drive on the marine vessel, and a steering assembly configured to pivot the marine drive about its respective steering axis, and a controller. The controller is configured to determine a minimum clearance between the drive assembly and an obstruction based on the at least one sensed position and set at least one operational parameter for the steering assembly based on the minimum clearance, wherein setting the at least one operational parameter includes setting a maximum pivot speed for pivoting the marine drive about its steering axis and a maximum actuation force for pivoting the marine drive about its steering axis. The steering assembly is then controlled based on the at least one operational parameter.

In non-limiting embodiments disclosed herein, a marine propulsion system for a marine vessel includes a propulsion assembly comprising at least one marine drive, a steering assembly for steering the at least one marine drive relative to the marine vessel, and a magnetic sensor positioned on the at least one marine drive or the steering assembly and configured to sense a magnetic field strength. A steering controller is configured set at least one operational parameter for the steering assembly based on the sensed magnetic field strength and to control the propulsion assembly based on the at least one operational parameter.

In non-limiting embodiments disclosed herein, a marine propulsion system for a marine vessel includes at least one marine drive for propelling the marine vessel through a body of water, a mounting assembly for pivotably supporting the at least one marine drive on the marine vessel, a steering assembly configured to steer the at least one drive relative to the mounting assembly, and a protective shield positioned on the steering assembly. The protective shield is configured to block access to an operational envelope of the at least one marine drive, the mounting assembly, and the steering assembly.

In independent embodiments, the steering assembly includes a steering actuator for pivoting the at least one marine drive about a steering axis and the protective shield is positioned on the steering actuator.

In independent embodiments, the protective shield includes an upper panel extending along an upper side of the steering actuator and a front panel extending along a front side of the steering actuator.

In independent embodiments, the protective shield projects laterally from the steering actuator towards a port side or a starboard side of the marine vessel.

In independent embodiments, the at least one marine drive includes a first marine drive and a second marine drive and the steering assembly includes a first steering actuator for steering the first marine drive and a second steering actuator for steering the second marine drive. The protective shield is a first protective shield positioned on the first steering actuator, and the marine propulsion system includes a second protective shield on the second steering actuator.

In independent embodiments, the marine propulsion system includes a steering controller configured to determine a position of the at least one marine drive and the steering assembly, determine a minimum clearance value between the at least one marine drive or the steering assembly and an obstruction, and set operational parameters for the steering assembly based on the minimum clearance value.

Various other features, objects, and advantages will be made apparent from the following description taken together with the drawings.

BRIEF DESCRIPTION OF THE DRAWINGS

The present disclosure is described with reference to the following drawings.

DETAILED DISCLOSURE

As used herein, unless otherwise limited or defined, discussion of particular directions is provided by example only, with regard to particular embodiments or relevant illustrations. For example, discussion of "top," "bottom," "front," "rear," "left," "right," "lateral," "vertical," and "longitudinal" features and/or relative motion, e.g., movement "up" and "down," is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally or alternatively, embodiments may be arranged in a different orientation such that "top" and "bottom" features are arranged horizontally relative to each other, for example in a "left-to-right" orientation. Additionally, use of the words "first," "second," "third," etc. is not intended to connote priority, importance, etc., but merely to distinguish one of several similar elements from another.

Marine vessels including propulsion systems for propelling the vessel through the water can include steering systems for steering the propulsion system, for example based on a user input at a helm of the marine vessel. Through research and development in the relevant field, the present inventors determined that current steering systems for marine drives include moving components that are exposed as steering and/or trimming maneuvers are executed on the propulsion system. As the marine drives are pivoted about corresponding steering and/or trim axes, the moving components of the steering system and/or the marine drives themselves may approach adjacent parts of the propulsion system or the marine vessel, thereby reducing the clearances therebetween. The present inventors have determined that the movement of these components of the steering system and/or the marine drives may be at risk of engaging other or colliding with parts of the steering and/or propulsion systems, which may also be moving or static components. Incidental engagement between these moving parts may interfere with a user's normal operation of the marine vessel and can increase the wear on the steering system, and/or other parts of the marine vessel and any equipment thereon. The present inventors thus have realized a need in the art to provide systems and/or components that help to maintain desired clearances between various parts of the propulsion system (such as the steering systems) and marine vessel. The present inventors further realized a need in the art to provide as systems and/or components that restrict the ability of external objects from entering an operational envelope of the propulsion assembly and/or prevent external objects from being pinched between an exposed moving component of the steering system, the propulsion system, and/or the marine vessel. The present disclosure is a result of these efforts.

Figure 1A:
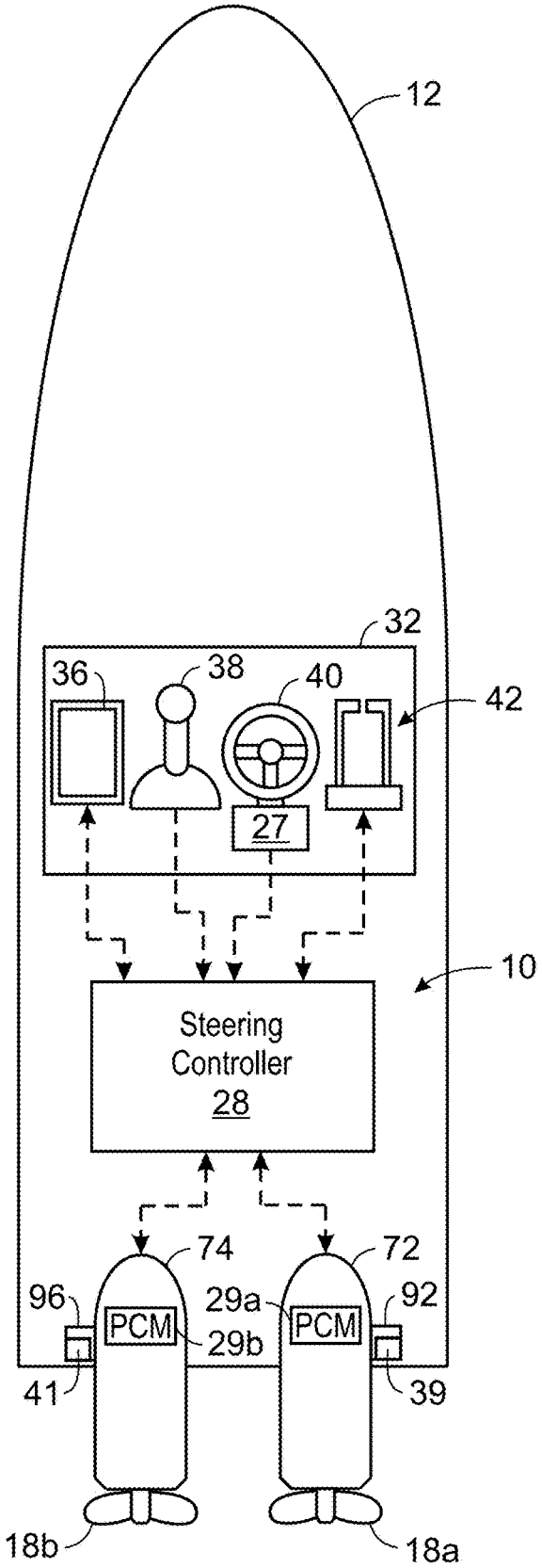
FIG. 1A is a schematic view of a steering control system on a marine vessel according to one embodiment of the present disclosure.

FIG. 1A illustrates a steering control system 10 for steering a plurality of marine drives 72 and 74 on a marine vessel 50. The marine drives 72, 74 shown are outboard motors; however, the marine drives could instead be inboard motors, stern drives, pod drives, outboard motors having steerable gearcases (such as disclosed in U.S. patent application Ser. No. 16/171,490, for example) and/or jet drives, or any other devices that are steerable and configured to propel a marine vessel. Each marine drive 72, 74 includes a powerhead coupled in a torque-transmitting relationship with the propeller 18*a*, 18*b* of the respective drive. The powerhead may be an internal combustion engine, for example, gasoline or diesel engine, an electric motor, and/or a hybrid thereof.

Steering actuators 92, 96 are configured to pivot the marine drives 72, 74, about their respective steering axes in accordance with steering commands from one or more user input devices, such as the helm devices described herein. The steering commands which are transmitted to the steering actuators 92, 96 by control commands from the steering controller 28. Each marine drive 72, 74 is rotated about its respective steering axis to a steering angle, such as a steering angle commanded by the steering controller 28 based on inputs from the steering wheel 40, joystick 38, or other user input device. Exemplary steering actuators 92, 96 include electric steering actuators comprising electric motors, pneumatic steering actuators, and hydraulic steering actuators. Exemplary steering actuators are shown and described in U.S. Pat. No. 10,518,858, which is incorporated herein.

A steering controller 28 is provided in signal communication with the helm devices with the associated sensors. In certain examples, the steering controller 28 communicates with the steering actuators 92, 96 and/or the propulsion control modules 29*a*, 29*b* (or PCMs) and/or other control devices associated with each of the marine drives 72, 74 via one or more communication links, such as via one or more CAN buses. Each controller 28, 29*a*, 29*b* comprises a processor configured to execute software, which can be stored in memory accessible by the processor. Example processor include general purpose processing units, application specific processors, and logic devices, as well as other processing devices, combination of the processing devices, and/or variations thereof. Executing the software causes the controller(s) to operate as described herein. The controller arrangement shown in FIG. 1A is merely exemplary, and in other embodiments the steering control system 10 may include fewer controllers, additional controllers, or a different arrangement of controllers than that depicted. For example, the steering control system 10 may include one or more thrust vector control modules (TVMs), one or more helm control modules (HCMs), one or more engine control modules (ECMs), and/or the like, which may be in addition to tor in place of any of the steering control module 28 or PCMs 29*a*, 29*b*.

The controller 28 can be located anywhere on the marine vessel 50 and is communicatively connected to the steering actuators 92, 96 and the marine drives 72, 74 and/or the controllers (e.g., PCMs) therefor. Various components of the control system may communicate with the steering actuators 92, 96 and the marine drives 72, 74 via wired and/or wireless links. The controller can have one or more microprocessors that are located together or remotely from each other in the control system or remotely from the control system.

The steering control system 10 receives user inputs from various user interface devices at the helm 32, such as steering devices, for example, a joystick 38, steering wheel 40, throttle shift levers 42, and a touchscreen display 36. The wheel position sensor 27, for example, senses and measures a rotational position of the steering wheel 40 so that the marine drives 72, 74 can be rotated, or steered, accordingly. Subject to the limitations imposed by the systems and control methods described herein, the steering control system 10 controls the marine drives 72, 74 based on the user inputs, including controlling the powerhead(s) based on the throttle shift inputs and/or joystick 38 inputs, and controlling steering based on the joystick 38 inputs and/or steering wheel 40 inputs. Various implementations of such "steer-by-wire" arrangements, whereby the steering actuators 92 and 96 are controlled by electronic signals from the steering controller 28 and/or other controllers within the control system 10, are known in the relevant art and may be implemented as part of the steering control system 10 and methods described herein.

The steering control system 10 may include one or more sensors configured to sense at least one position of a respective one of the marine drives 72, 74, which may include a sensed steering position and/or a position of one or more parts of the drive with respect to another devices or surface on the marine vessel. In the example in FIG. 1A, the system 10 includes steering position sensors 39, 41 configured detect the steering positions of the marine drives 72, 74 and provide signals to the steering control module 28, such as to be used as feedback for controlling the steering actuators 92, 96 and/or for calculating one or more positions of the marine drive according to methods described herein. Steering sensors 39, 41 are also provided in conjunction with each steering actuator 92, 96 to measure the steering position (e.g. the steering angle) of each marine drive 72, 74 at any given time. It will be recognized that the steering position measurement of each marine drive 72, 74 may be inferred based on a measured position of the respective steering actuator 92, 96, for example whereby the steering position sensors 39, 41 are encoders associated with the respective steering actuators 92, 96.

Figure 1B:
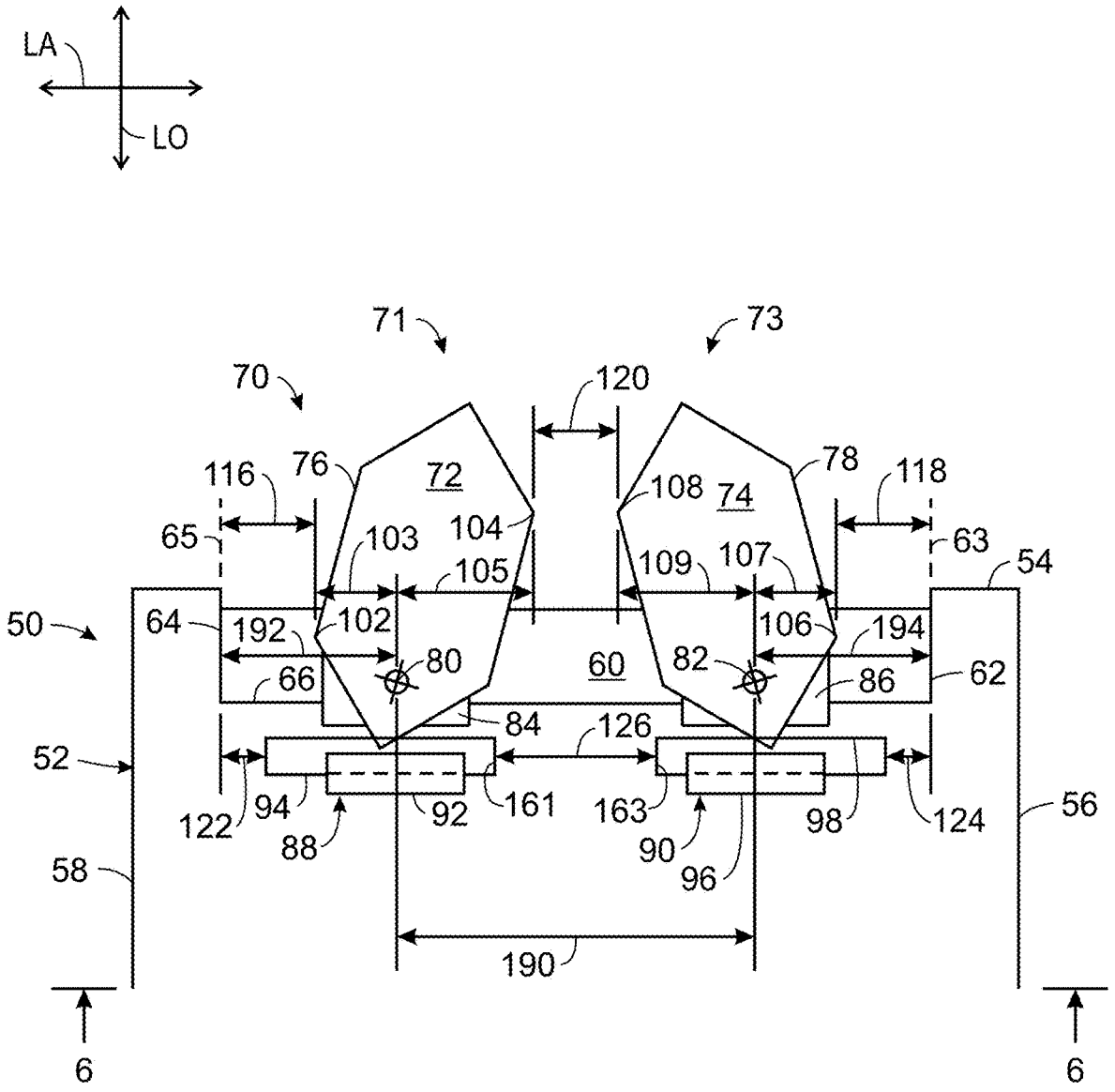
FIG. 1B is a schematic view of a marine drive assembly supported on the stern portion of a marine vessel.

FIG. 1B depicts the stern section of an embodiment of another marine vessel 50 with a propulsion assembly 70 configured to generate a thrust force for propelling the marine vessel 50 through a body of water and a steering control system for steering the propulsion assembly 70. In the illustrated embodiments, the hull 52 of the marine vessel 50 extends from bow (not shown) to stern 54 in a longitudinal direction LO and from a port side 56 to an opposite starboard side 58 in a lateral direction LA which is perpendicular to the longitudinal direction LO. The illustrated propulsion assembly 70 includes a first marine drive 72 and a second marine drive 74 that are mounted over a splash well 60 at the stern 54. The splash well 60 extends laterally between a port splash well wall 62 and a starboard splash well wall 64. The first and second marine drives 72, 74 each include a frame (not shown) that supports various components for generating a thrust force in the water (e.g., a combustion engine, an electric motor, a gearset, a transmission, a propeller, various electrical components, and/or other electrical or mechanical components) and a housing that encloses the internal frame and components thereof. The housings generally define an outer perimeter 76, 78 of each marine drive 72, 74. As discussed below, some embodiments of a steering control system may be configured for use with a marine vessel that does have a splash well, and/or with a propulsion assembly that includes a different number, type, and/or arrangement of marine drives.

With continued reference to FIG. 1B, the first marine drive 72 and second marine drive 74 are pivotably supported on a transom 66, which extends laterally between the opposing walls 62, 64 of the splash well 60, by a first mounting assembly 84 and a second mounting assembly 86, respectively. The first mounting assembly 84 supports the first marine drive 72 such that it is pivotable relative to the transom 66 about a first steering axis 80 and the second mounting assembly 86 supports the second marine drive 74 such that it is pivotable relative to the transom 66 about a first steering axis 80. First and second steering assemblies 88, 90 are operatively coupled to the first and second marine drives 72, 74 and can be controlled, for example by a steering controller (not shown), to pivot the first and second marine drives 72, 74 about the respective first and second steering axes 80, 82. Thus, the propulsion assembly 70 is steerable relative to the hull 52 of the marine vessel 50 by pivoting the first and second marine drives 72, 74 on their mounting assemblies 84, 86 about the first and second steering axes 80, 82

In the illustrated embodiments, the first steering assembly 88 and the second steering assembly 90 each include a steering actuator 92, 96 and a steering linkage 94, 98 that operatively couples the marine drives 72, 74 to the respective steering actuator 92, 96, In the embodiment shown in FIG. 1B, the steering actuators 92, 96 are fixed relative to the transom 66 and can be controlled to move the steering linkages 94, 98 laterally towards the port side 56 or the starboard side 58 of the marine vessel 50. Such linear lateral movement of the steering linkages 94, 98 forces the first and second marine drives 72, 74 to pivot about the first and second steering axes 80, 82, respectively. For example, in the illustrated embodiments, lateral movement of the steering linkages 94, 98 towards the port side 56 pivots the marine drives 72, 74 in a counterclockwise direction about the steering axes 80, 82, thereby turning marine drives towards the port side 56 and causing the marine vessel 50 to turn in the starboard direction. Lateral movement of the steering linkages 94, 98 towards the starboard side 58 pivots the marine drives 72, 74 in a clockwise direction about the steering axes 80, 82, thereby turning marine drives towards the starboard side 58 and causing the marine vessel 50 to turn in the port direction.

In the illustrated embodiments, the steering assemblies 88, 90 each include moving external components that are exposed to the environment while the propulsion assembly 70 is operated and during steering and trimming operations. In particular, the illustrated steering linkages 94, 98 each include at least one link member that is exposed and moves laterally relative to the transom 66 when the steering actuators 92, 96 are controlled to steer the marine drives 72, 74. However, some embodiments of a marine vessel 50 may include at least one steering assembly that is configured differently than the illustrated steering assemblies 88, 90. For example, at least one steering assembly may be configured as and internal steering actuator that is housed within a marine drive 72, 74 and/or in a mounting assembly 84, 86.

As previously mentioned, the propulsion system of the illustrated marine vessel 50 includes a steering control system for controlling the steering assemblies 88, 90 to steer the marine drives 72, 74. The steering control system may be configured to receive inputs from a user input devices at the helm, such as those described with respect to FIG. 1A, and to control the steering actuators 92, 96 to effectuate the corresponding commands, except for the limiting functions described herein. The control system is configured to output control signals to various components of the marine drives 72, 74, the mounting assemblies 84, 86, and/or the steering assemblies 88, 90, for example, to control the steering actuators 92, 96 to avoid collision and/or minimize the impact force of the collision, as described herein. In some examples, the control system can also be configured to generate output command signals based upon programming stored within the memory of the control system, such as for example in station keeping modes, trolling modes, way point tracking modes, auto heading, and/or the like, all of which are well known by those having ordinary skill in the art.

With continued reference to FIG. 1B, the steering movements of the first and second marine drives 72, 74 are limited by an operational envelope that defines the outer limits of where portions of the marine drives 72, 74 may move during normal operation of the propulsion assembly 70 without encountering an obstruction. An obstruction may be any portion of a marine drive 72, 74, a mounting assembly 84, 86, a steering assembly 88, 90, the hull 52 of the marine vessel 50, and/or any other component of the propulsion assembly 70 or the marine vessel 50 that can come into contact with a moving portion of the propulsion assembly 70. For example, the illustrated propulsion assembly 70 is configured to operate within an operational envelope that has a port side lateral operational boundary 63 defined by the port side wall 62 of the splash well 60 and a starboard side lateral operational boundary 65 defined by the starboard side wall 64 of the splash well 60. Additionally or alternatively, an obstruction may be a foreign (external) object that incidentally enters into the operational envelope of the propulsion assembly 70.

As the first steering assembly 88 and the second steering assembly 90 are operated to pivot the first marine drive 72 and the second marine drive 74 about the first steering axis 80 and the second steering axis 82, respectively, the positions and orientations of the marine drives 72, 74 and the moving components of the steering assemblies 88, 90 shift within the operational envelope. Thus, steering movements of the propulsion assembly 70 causes different parts of the propulsion assembly 70 to move closer to, or further from, the lateral operational boundaries 63, 65 of the envelope. To limit the risk of a part of the propulsion assembly 70 contacting an obstruction, the novel steering control system may be configured to limit how the steering actuators 92, 96 can be controlled based on the proximity of the propulsion assembly 70 to any obstructions. Embodiments of the steering controller may be communicatively connected to a first position sensor (e.g., steering position sensor 39 in FIG. 1A) configured to sense the orientation of the first marine drive 72 relative to the first steering axis 80 and a second position sensor (e.g., steering position sensor 41 in FIG. 1A) configured to sense the orientation of the second marine drive 74 relative to the second steering axis 82. The steering controller may also be configured to read stored configuration information regarding the dimensions of the marine vessel 50 (e.g., the overall dimensions of the marine vessel 50, the length of the transom 66 between the lateral splash well walls 62, 64, the longitudinal length of the splash well 60, etc.); the locations of the marine drives 72, 74 on the transom 66 (e.g., the lateral clearances 116, 118 between the first and second steering axes 80, 82 relative to the splash well walls 62, 64); the dimensions of each marine drive 72, 74; the dimensions of each steering assembly 88, 90; and/or any other known or measurable dimension of the marine vessel 50 or propulsion assembly 70.

The system may be configured to determine a minimum clearance between the propulsion assembly and an obstruction—e.g., a shortest distance between point(s) on at least one of the marine drives 72, 74 and/or the steering assembly and the obstruction—wherein the obstruction may be another marine drive, a surface of the marine vessel, or an object on the vessel. The minimum clearance may be a sensed value or a calculated value. For example, the minimum clearance may be based on output from a sensor on the marine drive, such as based on a magnetic sensor, an optical sensor, or another sensor type configured to sense a distance between a point on the marine drive or steering assembly and an obstacle. Alternatively or additionally, the steering system may be configured to calculate a distance between one or more points on the marine drive(s) and/or on the steering assemblies. For example, the steering system may be configured to calculate a lateral clearance and/or a drive-to-drive clearance for each marine drive to determine operational boundaries of each marine drive, as is described herein. Alternatively or additionally, the steering system may be configured to model the surface of the marine drive with respect to one or more obstacles, such as exemplified and described in U.S. Pat. No. 8,818,587 incorporated herein by reference.

Figure 2A:
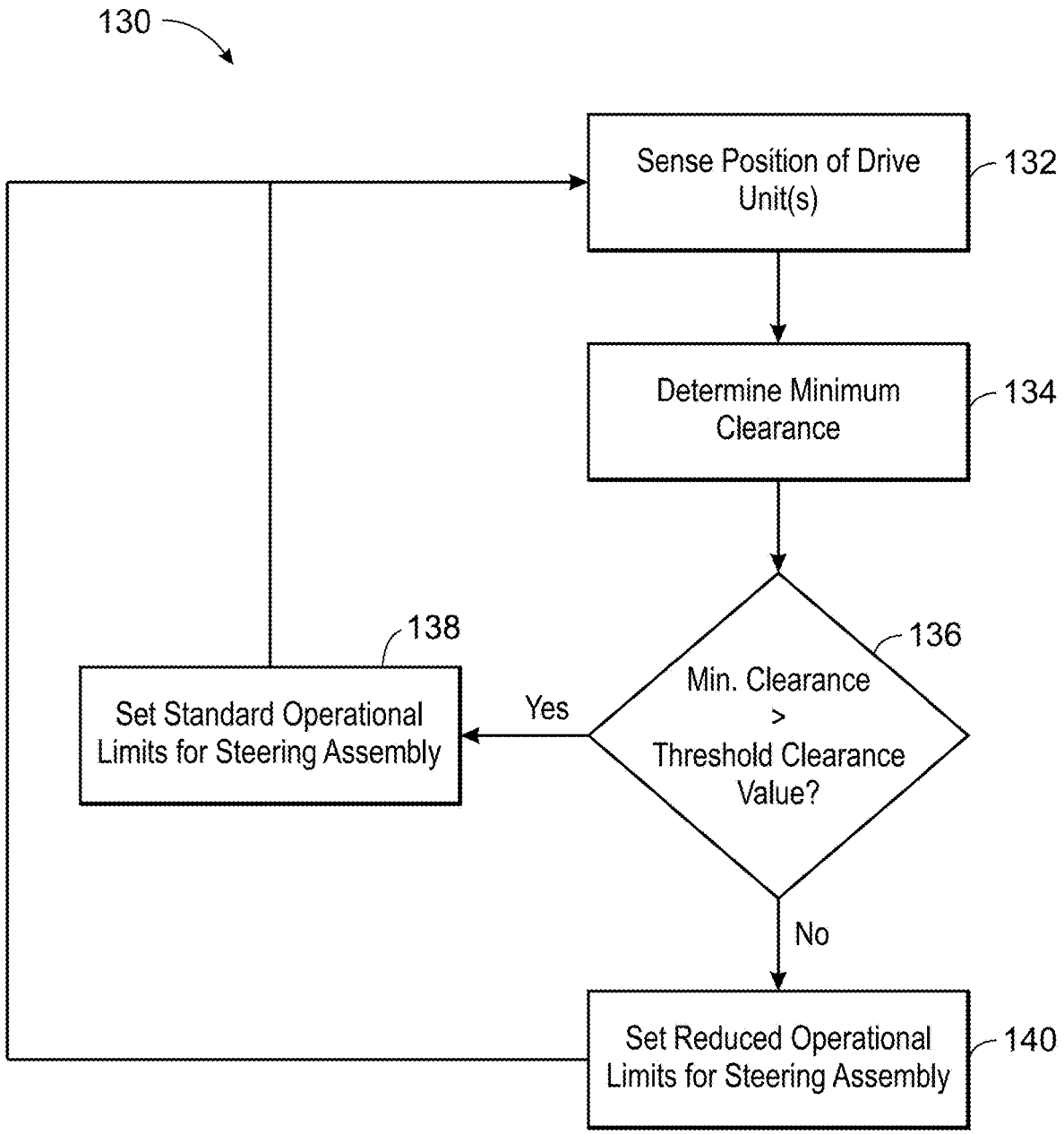
FIG. 2A illustrates an exemplary method for steering the marine drives of the drive assembly of FIG. 1A or 1B.

FIG. 2A illustrates an embodiment of a method 130 for controlling a propulsion assembly 70 (i.e., the propulsion assembly of FIG. 1B) to limit the risk of contacting any obstruction(s). The method 130 for controlling the propulsion assembly 70 may be performed by the steering controller and/or another controller within the control system on the marine vessel 50. At step 132, the positions of the marine drives 72, 74 are sensed. This may include sensing the steering positions and calculating the outermost points of the outer perimeter 76 of the first marine drive 72 and the outer perimeter 78 of the second marine drive 74, and/or may include sensing distances at predefined locations on the marine drives 72, 74. The steering controller may acquire the orientations of the first and second marine drives 72, 74 from the position sensors, and then use the sensed orientations of the marine drives 72, 74 and the known dimensions of the marine vessel 50 and propulsion assembly 70 to calculate outermost points 102, 104, 106, 108 of each marine drive 72, 74 (i.e., the point(s) on each marine drive 72, 74 that is closest to a given obstruction). For example, using the sensed orientation and known shape and size of the first marine drive 72, the steering controller can determine the locations of a starboard laterally outermost point 102 and a port laterally outermost point 104 of the first marine drive 72. Similarly, the steering controller can determine the locations of a starboard laterally outermost point 108 and a port laterally outermost point 106 of the second marine drive 74 using the sensed orientation and known shape and size thereof. Various different equations and/or methods may be used by the steering controller to identify the outermost points 102, 104, 106, 108 of the marine drive 72, 74. For example, the outermost points 102, 104, 106, 108 of the marine drive 72, 74 may be a function of the unique physical profile of the drive 72, 74 and the kinematics of the system related to drive steering angle about 80 or 82 and trim position.

In some embodiments, the locations of the outermost points 102, 104, 106, 108 of the marine drives 72, 74 may be calculated and/or recorded as a lateral position of each outermost point 102, 104, 106, 108 relative to the corresponding steering axis 80, 82. For example, the port and starboard laterally outermost points 102, 104 of the first marine drive 72 may be recorded as the lateral distances 103, 105 between the first steering axis 80 and said points 102, 104, and the port and starboard laterally outermost points 108, 106 of the second marine drive 74 may be recorded as the lateral distances 109, 107 between the first steering axis 80 and said points 108, 106. Some embodiments, however, may calculate and/or record the locations of the outermost points 102, 104, 106, 108 of the marine drives 72, 74 as a function of different values and/or dimensions.

After the outermost points 102, 104, 106, 108 of the marine drives 72, 74 have been calculated, the steering controller may be configured to determine a minimum clearance between at least one of the marine drives 72, 74 and an obstruction at step 134, wherein the obstruction may be another marine drive, a surface of the marine vessel, or an object on the vessel. Similarly to the identification of the outermost points 102, 104, 106, 108, the steering controller may be configured to determine the clearances between the identified outermost points 102, 104, 106, 108 using the orientations of the marine drives 72, 74 sensed by the position sensors and the known dimensions of the marine vessel 50 and propulsion assembly 70. For example, at least one of a clearance 116 between the starboard lateral operational boundary 65 and the first marine drive 72, a clearance 118 between the port lateral operational boundary 63 and the second marine drive 74, a drive-drive clearance between the first marine drive 72 and the second marine drive 74, and any other clearances between parts of the propulsion assembly 70 and an obstruction may be a function of the angle at 80, the angle at 82, 190, 192, 194 and the trim angle. Thus, the clearances 116, 118, 120 may be calculated according to the following equation(s):

Lateral Clearance 116 = Distance 192 – Distance 103;

wherein Distance 103=f (geometry of marine drive 72, steering angle about axis 80).

Lateral Clearance 118 = Distance 194 – Distance 107;

wherein Distance 107=f(geometry of marine drive 74, steering angle about axis 82).

Drive – Drive Clearance 120 =

Distance 190 – Distance 105 – Distance 109;

wherein Distance 105=f(geometry of marine drive 72, steering angle about axis 80) and Distance 109=f (geometry of marine drive 74, steering angle about axis 82).

In some embodiments, the lateral clearance 116 between the starboard laterally outermost point 102 on the first marine drive 72 may be calculated as a function of the known position of the first steering axis 80 relative to the starboard splash well wall 64 and the calculated lateral distance 103 between said outermost point 102 and the first steering axis 80. The lateral clearance 118 between the port laterally outermost point 106 on the second marine drive 74 may be calculated as a function of the known position of the second steering axis 82 relative to the port splash well wall 62 and the calculated lateral distance 107 between said outermost point 106 and the second steering axis 82. A drive-drive clearance 120 may be calculated as a function of the lateral separation between the first and second steering axes 80, 82 (which may be a known value or calculated using the known dimension of the transom 66 and the known positions 192, 194 of the steering axes 80, 82 thereon), the calculated lateral distance 105 between the port laterally outermost point 104 on the first marine drive 72 and the first steering axis 80, and the calculated lateral distance 109 between the starboard laterally outermost point 108 on the second marine drive 74 and the second steering axis 82.

Once the various clearances between components of the propulsion assembly 70 and any obstructions have been calculated (i.e., the lateral clearance116 of the first marine drive 72, the lateral clearance 118 of the second marine drive 74, the drive-drive clearance 120), the minimum clearance value may be determined by selecting the smallest calculated clearance value as the minimum clearance value. Some embodiments of a steering controller may be configured to calculate at least one other clearance between the propulsion assembly 70 and an obstruction. For example, a steering controller may determine a lateral clearance 122 between the steering linkage 94 of the first steering assembly 88 and the starboard lateral operational boundary 65, a lateral clearance 124 between the steering linkage 98 of the second steering assembly 90 and the port lateral operational boundary 63, an actuator-actuator clearance 126 between the steering linkages 94, 98 of the two steering assemblies 88, 90, and/or and other clearances between moving parts of the propulsion assembly 70 and an obstruction. Embodiments of a steering controller may be configured to use any determined clearance value as the minimum clearance value.

Alternatively or additionally, one or more sensors (such the magnetic sensor arrangement described herein) may be located to sense the position of the marine drive(s) 72, 74 with respect to known obstructions (including with respect to one another). These or other embodiments of perimeter calculations and/or distance sensing may be implemented separately or in combination to determine the minimum clearance at step 134.

After determining the minimum clearance value between the propulsion assembly 70 and an obstruction (which may be an internal obstruction where two elements within the drive assemblies 71 and 73 are close to one another), the steering controller can set operational parameters for the steering assembly based on the minimum clearance. The operational parameters may be any parameter relating to the movements of the propulsion assembly 70. For example, configurable operational parameters may include a pivot speed at which the marine drive 72, 74 is pivoted about a steering axis 80, 82 and/or a force with which a steering actuator 92, 96 drives rotation of a marine drive 72, 74 via the corresponding steering linkage 94, 98.

With continued reference to FIG. 2A, the steering controller may compare the minimum clearance to one or more threshold clearance values at step 136. The threshold clearance value may represent a first threshold distance between the propulsion assembly 70 (e.g., the drive assembly 71, 73) and an obstruction required for standard operation of the steering assemblies 88, 90 to steer the marine drives 72, 74. Additionally thresholds may be assessed as the clearance distance gets shorter, wherein the pivot speed and/or the actuation force are further limited as the minimum clearance decreases past the first threshold distance and approaches a final threshold distance. The threshold clearance value(s) may be a predetermined value or a value that is calculated or otherwise determined by the steering controller (and/or any other controller or control system of the marine vessel 50) based on operation parameters of the drive assemblies 71, 73, etc.

If the minimum clearance is greater than the threshold clearance value(s) (e.g., greater than all of the thresholds), the steering controller may operate under a standard set of operational parameters, which are set at step 138. For example, the speed or output force of the steering actuators 92, 96 will not be limited on the basis of clearance, and thus the control system may command up to 100% of the output capacity of the actuators 92, 96 as needed to meet the user's input command or other steering command. If, however, the minimum clearance is less than one or more the threshold clearance value(s), the steering controller sets reduced operational parameters for controlling the steering assemblies 88, 90 at step 140. The reduced operational parameters are limits on the maximum output of the steering assembly 88, 90, for example, setting maximum (i.e., not-to-exceed) values for output of the steering actuators 92, 96. Thus, the maximum output values cap the output of steering assembly 88, 90 such that the output may be less than the maximum value at any given time if the steering demand is low (e.g., the user is not commanding further steering change), but the output of the steering assembly 88, 90 is not permitted to exceed the maximum value even if meeting the steering demand (e.g., a user's steering command) requires doing so.

For example, setting reduced operational parameters may include setting a maximum rotational speed for pivoting the first and/or second marine drive(s) 72, 74 about the corresponding steering axis 80, 82 that is less than 100% of the output capabilities of the steering actuators 92, 96. This may be useful, for example, in order to reduce the speed at which the marine drives 72, 74 approach a nearby obstruction, thereby increasing the amount of time available to remove the obstruction and/or cease the movement of marine drives 72, 74 that would otherwise move them into contact with the obstruction and decreasing the rotational speed at which the drive is traveling if impact does occur. A rotational speed of one or both of the marine drives 72, 74 can be limited, for example, by setting a reduced limit for the current and/or voltage that is supplied to the steering actuators 92, 96, and/or by controlling another parameter for the operation of the propulsion assembly 70. Alternatively or additionally, the rotational speed of the marine drives 72, 74 may be limited by limiting the motor torque and/or rotational speed of the motor (e.g., for a BLDC motor) of an electric actuator. For a hydraulic actuator, pivot speed of the drive may be limited by limiting pump speed and/or valve position to limit flow of hydraulic fluid in the actuator.

Figure 2B:
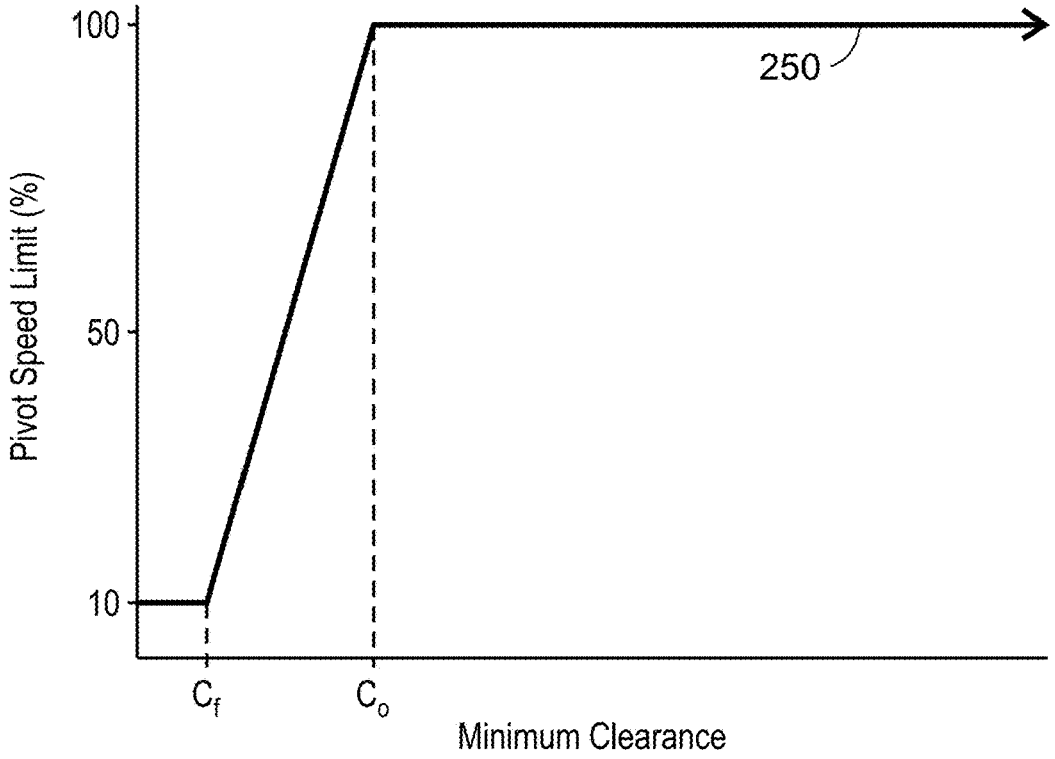
FIGS. 2B and 2C illustrate exemplary relationships between exemplary operational parameters for the steering assembly and minimum clearance values.
Figure 2C:
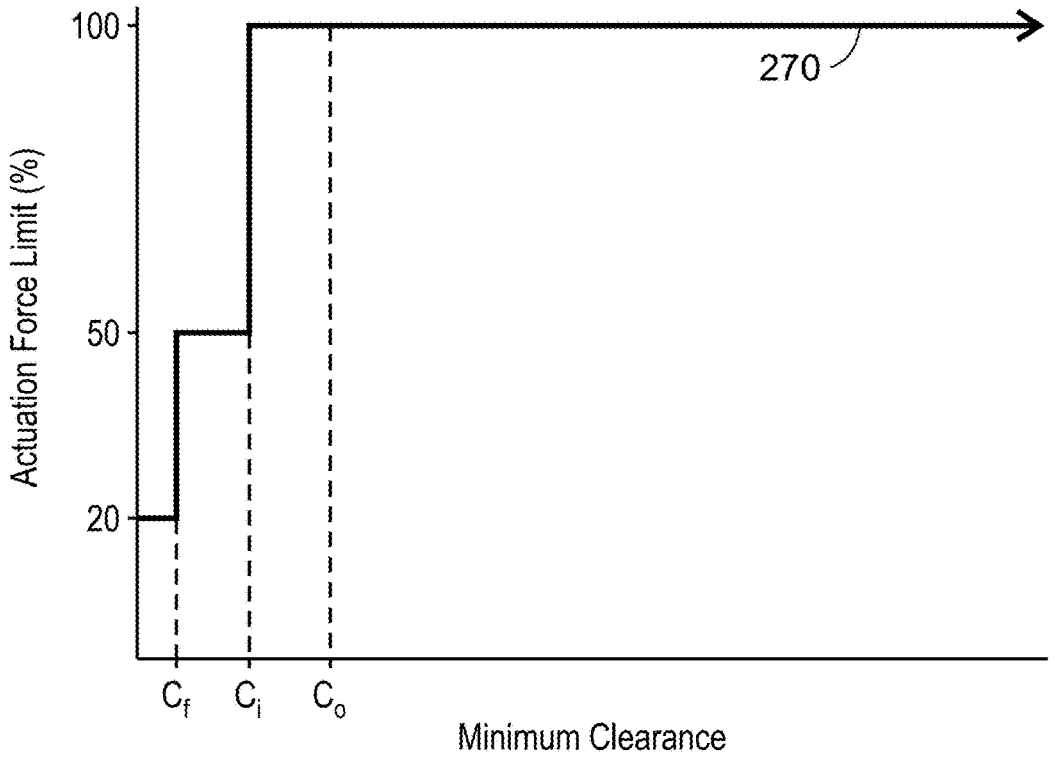

Additionally or alternatively, setting reduced operational parameters may include setting a maximum actuation force that may be applied to the marine drives(s) 72, 74 by the first and/or second steering actuator(s) 92, 96 via the steering linkages 94, 98. This may be useful, for example, in order to limit the force with which a marine drive 72, 74 is pressed into abutment with the obstruction to limit potential damage to the propulsion assembly 70 and/or the marine vessel 50. A reduced actuation force for a steering assembly 88, 90 may be set, for example, by setting a reduced limit for the current, duty cycle, and/or voltage that is supplied to the steering actuators 92, 96. Alternatively or additionally, the actuator force may be limited by limiting the motor torque of an electric actuator (e.g., with a BLDC motor) or limiting pump pressure of a hydraulic steering actuator. FIGS. 2B and 2C depict exemplary relationships between different operational parameters and minimum clearance. FIG. 2B is a graph showing an exemplary relationship between minimum clearance and maximum pivot speed (i.e., the pivot speed limit percent). Line 250 represents the maximum pivot speed. As the minimum clearance value decreases below a first threshold distance $C_o$, the maximum pivot speed decreases. Line 250 represents the maximum pivot speed. In the depicted embodiment, the maximum pivot speed 250 decreases linearly from 100% of the maximum rated output of the steering actuator to 10% of the maximum rated output of the steering actuator as the minimum clearance decreases between the first threshold distance $C_o$ and the final threshold distance $C_f$. In other embodiments, the relationship may be non-linear, rather than linear, such as a parabolic decrease or a stepwise decrease as the minimum clearance decreases between the first threshold distance $C_o$ and the final threshold distance $C_f$.

In implementing this embodiment, the control system is configured to move the drive at 10% of the maximum speed capacity of the steering actuator once the minimum clearance reaches and/or decreases below the final threshold distance $C_f$. Thus, the control system is configured to move the drive very slowly in response to a steering command in the direction of the obstacle once the final threshold distance is reached, but will not stop moving the drive towards the obstacle in response to a steering command that requires rotating the drive in that direction. Moving the drive slowly provides opportunity for the obstacle to move out of the way (if it is a movable obstacle such as the other marine drive or an object temporarily placed on the back of the vessel), and also significantly decreases the impact velocity of the marine drive(s) contact the obstacle. In other embodiments, the control system may be configured to pivot the drive at a different non-zero minimum value when the minimum clearance is less the final threshold distance $C_f$ For example, the non-zero minimum pivot speed may be less, such as 5%, or may be greater, such as 15% or 20%. In still other embodiments, the control system may be configured to stop pivoting the drive when the minimum clearance is equal to or less than the final threshold distance $C_f$ such that the pivot speed becomes zero once the minimum clearance reaches the final threshold distance $C_f$.

The maximum pivot speed values may be stored in a table or index with respect to minimum clearance values (e.g., distance values or sensed values, such as field strengths).

Alternatively, the controller may store one or more models utilized to calculate maximum pivot speed based on the current minimum clearance value. The steering actuator(s) are then controlled so as not to exceed the maximum pivot speed, which may be effectuated by limiting any of various control parameters that result in controlling the rotation speed and which will be dependent on the configuration of the steering actuator(s). Controlling current (or duty cycle of the motor) or torque (e.g., of a BLDC motor) of an electric actuator and controlling pump speed in a hydraulic actuator are a few examples, other exemplary control parameters are described herein.

FIG. 2C is a graph showing an exemplary relationship between minimum clearance and maximum actuation force (i.e., the actuation force limit percent). Line 270 represents the maximum actuation force. In the depicted embodiment, the maximum actuation force 270 decreases in a stepwise manner from 100% of the maximum rated output of the steering actuator to 20% of the maximum rated output of the steering actuator as the minimum clearance decreases between a threshold distance Ci (which, here, is different than and less than the first threshold $C_o$) and the final threshold distance $C_f$. In this example, the maximum actuator force 270 decreases in two steps at two thresholds. In other embodiments, the actuator force may be decreased more aggressively, such as in one step change at the final threshold distance $C_f$, or may be decreased more gradually, such as multiple smaller steps at multiple thresholds between the threshold distance Ci and the final threshold distance $C_f$, or between the first threshold distance $C_o$ and the final threshold distance $C_f$. In still other embodiments, the relationship between the minimum clearance and the actuation force may be different, such as a linear decrease or an exponential decrease within the threshold region between the threshold distance Ci and the final threshold distance $C_f$, or between the first threshold distance $C_o$ and the final threshold distance $C_f$.

In implementing this embodiment, the control system is configured to apply up to 50% of the maximum force capacity of the steering actuator once the minimum clearance reaches and/or decreases below the threshold distance Ci and to further decrease the maximum force to 20% of the maximum force capacity of the actuator once the minimum clearance reaches and/or decreases below the final threshold distance $C_f$. Thus, the control system is configured to apply a non-zero minimum amount of force once the minimum clearance is less than the final threshold distance $C_f$. This minimizes the amount of force that could be imparted if the drive contacts the obstacle, and thus decreases the risk of damage to the cowl and/or to the obstacle. In other embodiments, the non-zero minimum value may be greater or less than that shown, such as 15% of the maximum force capacity or up to 50% of the maximum force capacity. In some implementations, the non-zero minimum force value may be calibrated based on the amount of force needed to keep the drive in a steering position associated with, or expected for, the final threshold distance $C_f$, such as to counteract expected hydrodynamic forces. The non-zero minimum value may be a calibrated fixed value, or in some implementations, may be a calibrated variable value based on steering position of the drive and/or vessel speed.

The maximum actuation speed values may be stored in a table or index with respect to minimum clearance values (e.g., distance values or sensed values, such as field strengths). Alternatively, the controller may store one or more models utilized to calculate maximum actuation speed based on the current minimum clearance value. The steering actuator(s) are then controlled so as not to exceed the maximum actuation speed, which may be effectuated by limiting any of various control parameters that result in controlling the actuation force exerted by the steering actuators and which will be dependent on the configuration of the steering actuator(s). Controlling current (or duty cycle of the motor) or torque (e.g., of a BLDC motor) of an electric actuator and controlling pump pressure in a hydraulic actuator are a few examples, other exemplary control parameters are described herein.

The actuation force limit may be used alone as a limited operational parameter or may be used in conjunction with limiting the pivot speed. Likewise, the pivot speed limiting described herein may be used alone or in conjunction with limiting actuation force. Where both pivot speed and actuation force are limited, the threshold distances used for determining the maximum force and speed values may be the same, or different thresholds may be used. Thus, for example, the final threshold distance $C_f$ value for triggering the non-zero minimum force value may be the same as or different from the final threshold distance $C_f$ value for triggering the minimum pivot speed (whether zero or non-zero).

In the embodiment of FIGS. 1A and 1B, a steering controller 28 is configured to set operational parameters for steering the propulsion assembly 70 based on a clearance 120 between the first and second marine drives 72, 74 or a clearance 116, 118 between the first and second marine drives 72, 74 and lateral operational boundaries 63, 65 defined by the splash well walls 62, 64, such as reducing the operational parameters when a minimum clearance (e.g., a smallest value among the aforementioned values) is less than one or more threshold clearance values. The steering controller 28 may be configured to operate based on a different number of marine drives and/or different operational boundaries. For example, a steering controller for a marine vessel 50 equipped with a propulsion assembly 70 including more than two marine drives may be configured to monitor clearances between each of the drives, and clearances between each marine drive and lateral, longitudinal, or vertical operational boundaries. In some embodiments, at least one operational boundary for a propulsion assembly 70 may be defined by something other than a wall 62, 64 of the splash well 60. For example, the lateral operational boundaries 63, 65 for a propulsion assembly 70 on a marine vessel that does not include a splash well may be defined by the port side edge 56 and/or the starboard side edge 58 of the hull 52 of the marine vessel 50.

In some embodiments, a steering controller may be configured for use with a propulsion assembly 70 including at least one marine drive 72, 74 that is trimmable up and down relative to a trim axis (not shown), which may be generally parallel to the lateral direction LA. In such an embodiment, the outer perimeters 76, 78 of the marine drives 72, 74 may be a function of a trim position of said marine drive 72, 74. A steering controller performing a method for controlling a propulsion assembly 70 with a trimmable marine drive 72, 74 (e.g., the method 130 of FIG. 2A) may be configured to determine a position of the marine drives 72, 74 as a function of the steering position of the marine drives 72, 74 relative to the steering axes 80, 82 (e.g., as measured by the first and second steering position sensors) and the trim position of the marine drives 72, 74 relative to their trim axes, which may be sensed using corresponding trim positions sensors (not shown). In such embodiments, the minimum clearance may be identified based on the calculated clearances (e.g., the clearances 116, 118, 120).

Alternatively or additionally, the steering control system for the propulsion assembly 70 of a marine vessel 50 may be configured with at least one sensor for actively sensing the proximity of an obstruction to a marine drive 72, 74, a steering assembly 88, 90, and/or another portion of the propulsion assembly 70. In such embodiments, the minimum clearance may be identified based on the sensed clearances. For example, FIGS. 3 and 4 schematically illustrate an embodiment of a propulsion assembly 70 configured with a magnetic sensor 152 for detecting the presence of an external obstruction 158 between the first drive assembly 71 (including the first marine drive 72, the first mounting assembly 84, and the first steering assembly 88) and the second drive assembly 73 (including the second marine drive 74, the second mounting assembly 86, and the second steering assembly 90).

Figure 3:
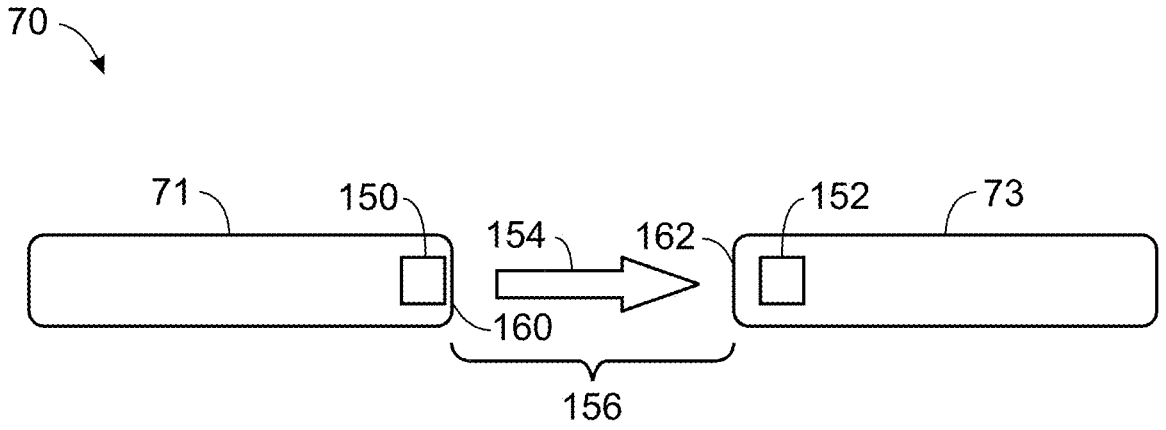
FIGS. 3 and 4 are schematic views of an object detection system for a marine drive assembly.
Figure 4:
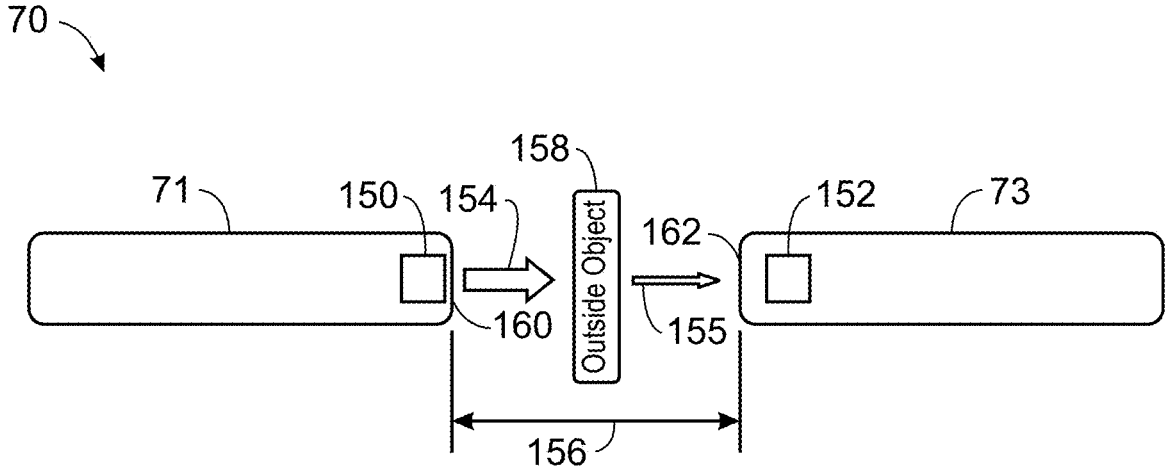

In the embodiments of FIGS. 3 and 4, the magnetic sensor 152 is positioned on a laterally inner (port) side 160 of the second drive assembly 73 and is configured to measure the strength of a magnetic field 154 produced by a magnet 150 positioned on a laterally inner (starboard) side 162 the first drive assembly 71. The strength of the magnetic field 154 produced by the magnet 150 is a known value and is stored in a computer memory accessible by the steering controller. By comparing the field strength measured by the magnetic sensor 152 to the known strength of the magnetic field 154 produced by the magnet 150, the steering controller may calculate the distance between the magnet 150 and the magnetic sensor 152.

Thus, the steering controller can determine a clearance between a portion of the propulsion assembly 70 including the magnetic sensor 152 and an obstruction on which the magnet 150 is positioned (e.g., another portion of the propulsion assembly 70 and/or a part of the marine vessel 50 including a magnet 150) based on magnetic field strength measurements. This may be useful in order to measure a clearance between two moving parts of the propulsion assembly 70 that may approach each other. For example, referring to FIGS. 1 and 3, a propulsion assembly 70 may be configured with a magnet 150 on a first one of the laterally inner end 161 of the first steering linkage 94 (FIG. 1) and the laterally inner end 163 of the second steering linkage 98 (FIG. 1), and a magnetic sensor 152 on the other one of the laterally inner end 161 of the first steering linkage 94 and the laterally inner end 163 of the second steering linkage 98.

Some embodiments, however, may be differently configured. Embodiments of a propulsion assembly 70 may be configured with a magnet 150 and/or a magnetic sensor 152 positioned on at least one of a different part of a steering assembly 88, 90, a mounting assembly 84, 86, a marine drive 72, 74, a part of the marine vessel 50, and/or on any other part or object that may act as an obstruction in the operational envelope of the propulsion system. For example, a propulsion assembly 70 may be configured with a magnet 150 and corresponding magnetic sensor 152 positioned on the first or second marine drive 72, 74 and an adjacent side wall 62, 64 of the splash well 60 (FIG. 1) in order to measure the lateral clearance 116, 118 between said marine drive 72, 74 and the splash well side wall 62, 64.

With continued reference to FIGS. 3 and 4, some embodiments of a steering controller may be configured to detect the presence of an external obstruction 158 between the first drive assembly 71 and the second drive assembly 73 (and/or between a different part of the propulsion assembly 70 and an obstruction containing a magnet 150) based on field strength measurements from the magnetic sensor 152. When the magnet 150 is a known distance away from the magnetic sensor 152, for example when the location of the magnet 150 and the location of the magnetic sensor 152 are either known or determined by the steering controller (for example according to step 132 of the method 130 of FIG. 2), the expected strength of the magnetic field 154 as measured by the magnetic sensor 152 can be calculated as a function of the known strength of the magnetic field 154 and the clearance 156 between the magnet 150 and the magnetic sensor 152. When an obstruction 158 moves between the magnet 150 and the magnetic sensor 152, as illustrated in FIG. 4, the magnetic field 154 produced by the magnet 150 is at least partially blocked so that the magnetic field 155 which reaches the magnetic sensor 152 is weaker than the expected field strength. Thus, the steering controller can detect an object between the magnet 150 and the magnetic sensor 152 based on a comparison of the measured magnetic field strength to the expected magnetic field strength.

Figure 5:
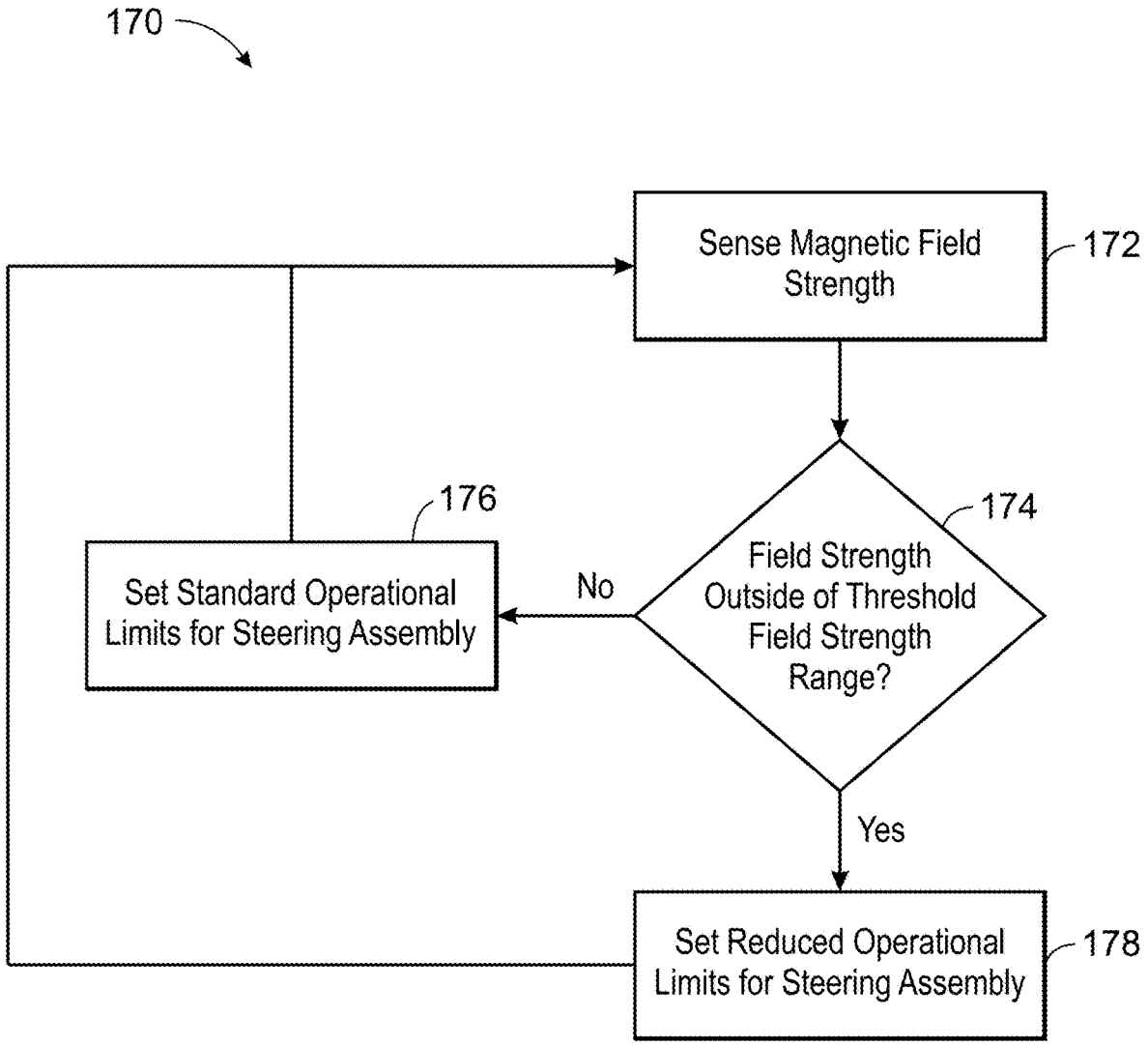
FIG. 5 illustrates another exemplary method for steering the marine drives of a drive assembly.

Referring to FIG. 5, an embodiment of a method 170 for controlling a propulsion assembly 70 equipped with a magnetic sensor 152 is illustrated. At step 172, the steering controller (and/or any other controller or control system on the marine vessel 50) may use the magnetic sensor 152 to measure the strength of the magnetic field 154 produced by a magnet 150 located on another portion of the propulsion assembly (or on an obstruction). In some embodiments, the steering controller may constantly sense the strength of the magnetic field 154 using the magnetic sensor 152. In other embodiments, however, the steering controller may be configured to begin sensing the magnetic field strength with the magnetic sensor 152 after the magnet 150 and the magnetic sensor 152 are within a predetermined threshold range from each other, for example as calculated by the methods described above.

After the strength of the magnetic field 154 produced by the magnet 150 has been sensed by the magnetic sensor 152, the steering controller may use the measured magnetic field strength to set operational parameters for the steering assemblies 88, 90. With continued reference to FIG. 5, the steering controller can compare the measured strength of the magnetic field 154 from the magnetic sensor 152 to a threshold range of field strength values at step 174. For example, the measured magnetic field strength may be compared to an upper threshold field strength value and a lower threshold field strength value. The threshold field strength values may be predetermined values, or they may be calculated as a function of the expected field strength for a given clearance 156 between the magnet 150 and the magnetic sensor 152. The measured field strength would be a function of the relative distance between the magnetic sensor 152 and the magnet 150 and the applied reluctance path that accounts for the measurement environment to determine the anticipated flux representing each one more the threshold distance(s). If the measured magnetic field strength does not exceed the threshold field strength value(s), the steering controller may operate under a standard set of operational parameters, which can be set at step 176. However, if the measured magnetic field strength is outside of the threshold magnetic field strength range, the steering controller can set reduced operational parameters for controlling the steering assemblies 88, 90 at step 178. If the measured magnetic field strength is below a lower threshold field strength value, the steering controller may determine that an obstruction is present between the magnetic sensor 152 and the magnet 150 and set corresponding reduced operational parameters for steering the propulsion assembly 70. Additionally or alternatively, if the measured magnetic field strength exceeds an upper threshold field strength value, the steering controller may determine that a clearance between the magnet 150 and the magnetic sensor 152 is less than a threshold clearance value and set corresponding reduced operational parameters for steering the propulsion assembly 70. In some embodiments, multiple upper threshold field strength values may be associated with multiple distance thresholds, such as those described with respect to FIGS. 2B and 2C, wherein each of the upper threshold field strength values is associated with implementing one or more reduced operational parameters. As previously discussed, setting reduced operational parameters may include setting a reduced maximum speed for steering a marine drive 72, 74 about the corresponding steering axis 80, 82 and/or setting a reduced maximum actuating force used to pivot a marine drive 72, 74 via a steering assembly 88, 90.

In some embodiments, at least one step from the method 130 for controlling the propulsion assembly 70 of FIG. 2A may be used in conjunction with the method 170 for controlling the propulsion assembly 70 of FIG. 5. This may be useful, for example, so that the steering controller can set different reduced operational parameters for steering the propulsion assembly 70 according to different sets of conditions. For example, a first set of reduced operational parameters may be set in response to the steering system determining that a measured minimum clearance is below a threshold clearance value and a second set of further reduced operational parameters may be set in response to the steering system detecting an obstruction between two parts of the propulsion assembly 70 and/or the marine vessel 50 based on magnetic field measurements. Similarly, the different methods may be implemented to identify and respond to different obstruction risks.

In some embodiments, the reduced set of operational parameters may be constant values that are predetermined or calculated by the steering a controller. Additionally or alternatively, a set of reduced operational parameters may vary depending on the conditions determined by the steering controller. For example, at least one reduced operational parameter for steering the propulsion assembly 70 may vary as function of the measured minimum clearance value, the measured magnetic field strength, and/or any other parameter determined by the steering controller. This may be useful, for example, in order to continuously limit operational parameters for steering the propulsion assembly 70 based on its proximity to an obstruction in order to further reduce the risk of incidentally contacting the obstruction.

Figure 6:
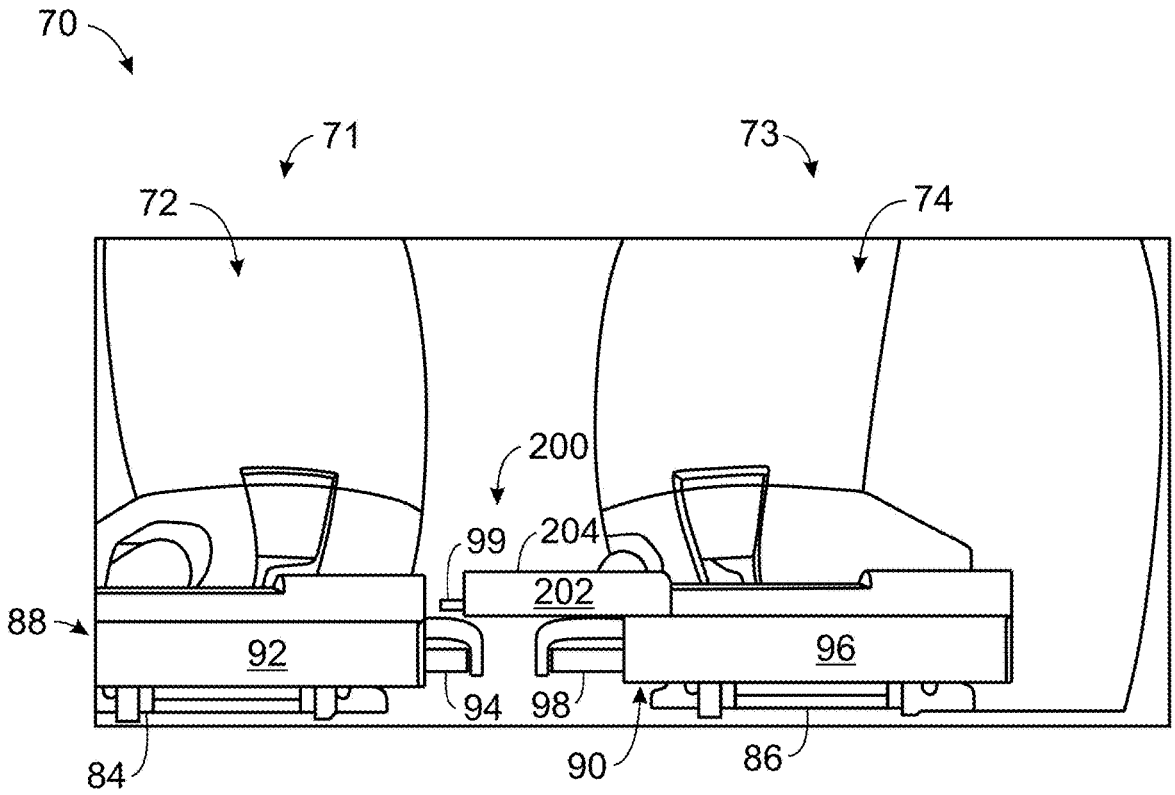
FIG. 6 is a front view of section 6-6, taken in FIG. 1B, with steering assemblies that include a deflector plate.
Figure 7:
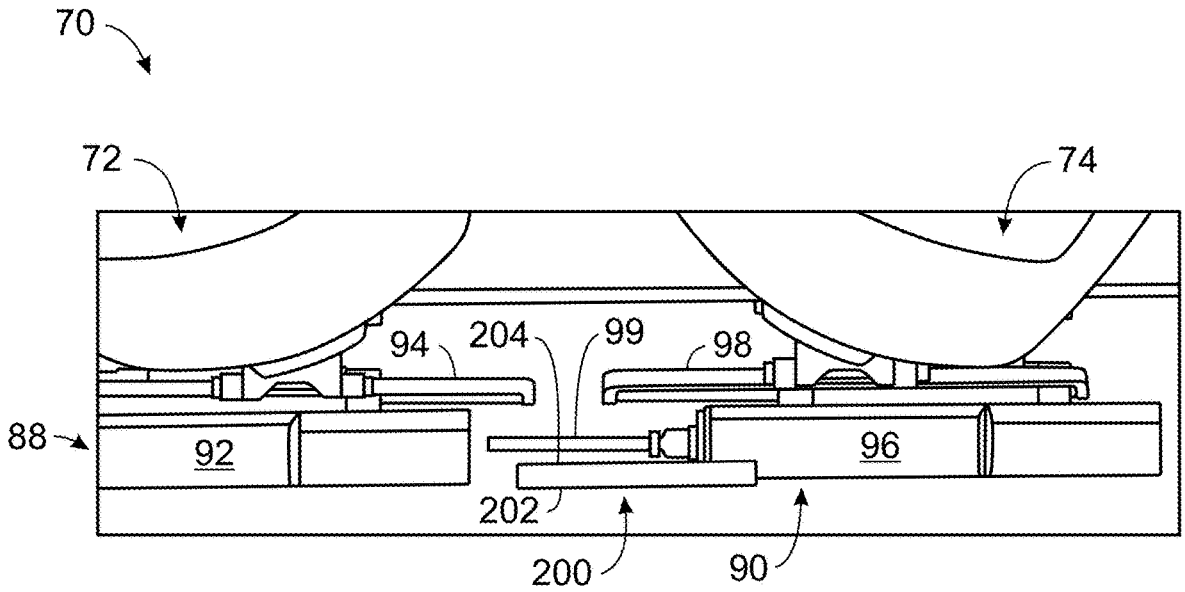
FIG. 7 is a top-down view of the steering assemblies and deflector plates of FIG. 7.

Some embodiments of a propulsion assembly 70 for a marine vessel 50 may be configured with a protective barrier configured to prevent an external object from entering into the operational envelope of the propulsion assembly 70. For example, FIGS. 6 and 7 illustrate an embodiment of a propulsion assembly 70 that includes a protective shield 200 configured to prevent external obstructions from entering the space between the first drive assembly 71 and the second drive assembly 73. In the illustrated embodiments, the protective shield 200 is mounted on the steering actuator 96 of the second steering assembly 90 includes a plurality of deflector plates 202, 204 that block access to the space between the two steering assemblies 88, 90. In particular, the protective shield 200 has a generally L-shaped profile formed by a front deflector plate 202 positioned along a front side of the second steering actuator 96 and an upper deflector plate 204 positioned along a top side of the second steering actuator 96. The front and upper deflector plates 202, 204 project laterally outward from the second steering actuator 96 towards the first steering actuator 92 and protect any components therebetween from external obstructions entering into the operational envelope. This may be useful, for example, to prevent an obstruction from moving into the space between the steering linkages 94, 98, which are moved laterally by the steering actuators 92, 96 in order to steer the marine drives 72, 74. Additionally or alternatively, the protective shield 200 may advantageously protect any electrical connectors 99 for the marine drives 72, 74 and/or the steering actuators 92, 96.

Figure 8:
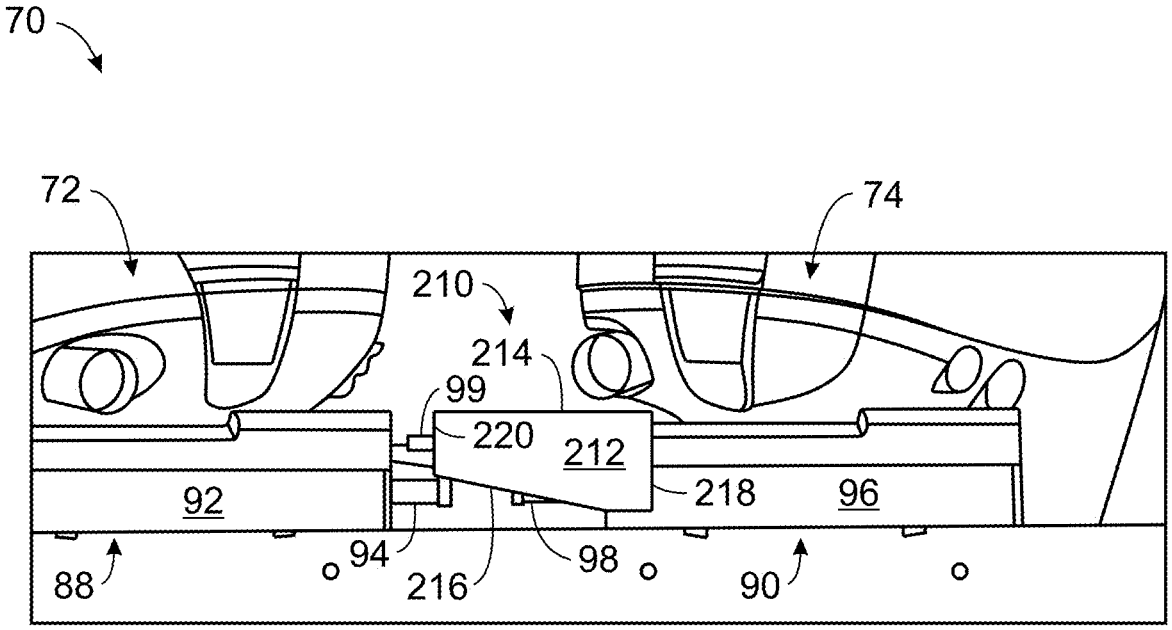
FIG. 8 is a front view of section 6-6, taken in FIG. 1B, with steering assemblies that include another embodiment of a deflector plate.

In the embodiments of FIGS. 6 and 7, the protective shield 200 has upper and front deflector plates 202, 204 that are generally rectangular. Some embodiments, however, may be differently configured. For example, FIG. 8 illustrates an embodiment of a propulsion assembly 70 that includes a protective shield 210 with at least one tapered deflector plate 212, 214. In the illustrated embodiment, the front deflector plate 212 has a lower edge 216 that tapers between a comparatively taller mounting end 218 secured to the second steering actuator 96 to a shorter distal end 220 opposite the mounting end 218. The tapered front deflector plate 212 covers a larger area that the front deflector plate 202 of the protective shield 200 of FIGS. 6 and 7, thereby offering greater protection from an obstruction from moving into the space between the first and second steering assemblies 88, 90. This may be useful, for example, in order to prevent an obstruction from engaging the steering linkages 94, 98 of the steering assemblies 88, 90 as they are moved laterally by the steering actuators 92, 96 in order to steer the marine drives 72, 74. Some embodiments of a protective shield 210 may additionally or alternatively include a tapered upper deflector plate 214.

In the embodiments of FIGS. 6-8, the propulsion assembly 70 includes one protective shield 200, 210 that is mounted on the second steering assembly 90 and projects laterally outward therefrom in the starboard direction towards the first steering assembly 88. Some embodiments, however, may be differently configured. For example, a propulsion assembly 70 may be configured with a first protective shield on the first steering assembly 88 and a second protective shield on the second steering assembly 90, at least one of which may be different than those of the illustrated embodiments. At least one protective shield may be configured to extend laterally outward from one steering assembly 88, 90 away from the other steering assembly 88, 90. Additionally or alternatively, a protective shield may be mounted on a different portion of the propulsion assembly 70 and/or the marine vessel 50.

This written description uses examples to disclose the invention and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A method of controlling steering for a marine vessel, the method comprising:

sensing at least one position of at least one of a drive assembly on the marine vessel, wherein each drive assembly includes a marine drive, a mounting assembly configured to pivotably support the marine drive on the marine vessel, and a steering assembly configured to pivot the marine drive about its respective steering axis;

determining a minimum clearance between the drive assembly and an obstruction based on the at least one sensed position;

setting at least one operational parameter for the steering assembly based on the minimum clearance, wherein setting the at least one operational parameter includes setting a maximum pivot speed for pivoting the marine drive about its steering axis and a maximum actuation force for pivoting the marine drive about its steering axis; and controlling the steering assembly based on the at least one operational parameter.

2. The method of claim 1, wherein controlling the steering assembly based on the at least one operational parameter includes limiting output of the steering assembly responsive to a steering command such that the maximum pivot speed is not exceeded and/or the maximum actuation force is not exceeded.

3. The method of claim 1, further comprising progressively decreasing the maximum pivot speed as the minimum clearance decreases.

4. The method of claim 1, further comprising comparing the minimum clearance to at least one threshold clearance;

wherein setting the at least one operational parameter for the steering assembly includes determining the maximum pivot speed and/or the maximum actuation force based on the comparison.

5. The method of claim 4, further comprising comparing the minimum clearance to multiple threshold distances, including a first threshold distance and a final threshold distance;

wherein setting the at least one operational parameter includes progressively decreasing the maximum pivot speed as the minimum clearance decreases between the first threshold distance and the final threshold distance.

6. The method of claim 5, wherein setting the at least one operational parameter includes setting the maximum pivot speed equal to zero when the minimum clearance is less than or equal to the final threshold distance.

7. The method of claim 5, wherein setting the at least one operational parameter includes setting the maximum pivot speed to a non-zero minimum value when the minimum clearance is less than the final threshold distance.

8. The method of claim 4, further comprising comparing the minimum clearance to a final threshold distance;

wherein setting the at least one operational parameter includes minimizing the maximum actuation force when the minimum clearance is less than the final threshold distance.

9. The method of claim 1, wherein sensing the at least one position includes sensing a steering position of the marine drive with a steering position sensor;

wherein determining the minimum clearance comprises calculating the minimum clearance based on the steering position of the marine drive.

10. The method of claim 9, wherein calculating the minimum clearance includes determining a lateral clearance between the marine drive and one more lateral operational boundaries of the marine drive based on the steering position and/or determining a drive-to-drive clearance between the marine drive and an adjacent marine drive based on the steering position of the marine drive and a steering position of the adjacent marine drive.

11. The method of claim 1, wherein sensing the at least one position includes sensing a magnetic field strength indicative of the minimum distance, and further comprising:

comparing the magnetic field strength to one more threshold field strengths; and wherein setting the at least one operational parameter for the steering assembly includes determining the maximum pivot speed and/or the maximum actuation force based on the comparison.

12. The method of claim 11, wherein setting the at least one operational parameter includes decreasing the maximum pivot speed and the maximum actuation force as the magnetic field strength increases.

13. A steering control system for a marine vessel, the system comprising:

at least one sensor configured to sense a position of at least one of a drive assembly on the marine vessel, wherein each drive assembly includes a marine drive, a mounting assembly configured to pivotably support the marine drive on the marine vessel, and a steering assembly configured to pivot the marine drive about its respective steering axis;

a controller configured to:

determine a minimum clearance between the drive assembly and an obstruction based on the at least one sensed position;

set at least one operational parameter for the steering assembly based on the minimum clearance, wherein setting the at least one operational parameter includes setting a maximum pivot speed for pivoting the marine drive about its steering axis and a maximum actuation force for pivoting the marine drive about its steering axis; and control the steering assembly based on the at least one operational parameter.

14. The steering control system of claim 13, wherein the controller is further configured to limit output of the steering assembly generated in response to a steering command such that the maximum pivot speed is not exceeded and/or the maximum actuation force is not exceeded.

15. The steering control system of claim 13, wherein the controller is further configured to progressively decrease the maximum pivot speed as the minimum clearance decreases.

16. The steering control system of claim 13, wherein the controller is further configured to:

compare the minimum clearance to at least one threshold clearance;

determine the maximum pivot speed and/or the maximum actuation force based on the comparison.

17. The steering control system of claim 13, wherein the controller is further configured to:

compare the minimum clearance to multiple threshold distances, including a first threshold distance and a final threshold distance;

progressively decrease the maximum pivot speed as the minimum clearance decreases between the first threshold distance and the final threshold distance.

18. The steering control system of claim 13, wherein the controller is further configured to:

compare the minimum clearance to a final threshold distance;

minimize the maximum actuation force when the minimum clearance is less than the final threshold distance.

19. The steering control system of claim 13, wherein the sensor is a steering position sensor configured to sense a steering position of the marine drive;

wherein the controller is further configured to determine the minimum clearance based on the sensed steering position of the marine drive.

20. The steering control system of claim 13, wherein the sensor is a magnetic sensor configured to sense a magnetic field strength indicative of the minimum distance between the obstruction and a portion of the drive assembly;

wherein the controller is further configured to:

compare the magnetic field strength to one more threshold field strengths; and determine the maximum pivot speed and/or the maximum actuation force based on the comparison.

21. The steering control system of claim 20, wherein the controller is further configured to decrease the maximum pivot speed and/or the maximum actuation force as the magnetic field strength increases.

* * * * *